US005623738A

United States Patent [19]

Biancalani et al.

[11] Patent Number: 5,623,738

[45] Date of Patent: Apr. 29, 1997

[54] MACHINE AND METHOD FOR THE CONTINUOUS WASHING OF A FABRIC

[75] Inventors: Fiorenzo Biancalani, Prato; Luigi Marcora, Vicchio, both of Italy

[73] Assignees: Officina Meccanica Biancalani & C. di Fiorenzo Biancalani & C. S.n.c.; Coramtex S.r.l., both of Prato, Italy

[21] Appl. No.: 400,620

[22] Filed: Mar. 8, 1995

[51] Int. Cl.[6] ..... D06B 3/28

[52] U.S. Cl. ..... 8/152; 8/158; 68/22 R; 68/178

[58] Field of Search ..... 8/152, 158; 68/9, 68/22 R, 27, 176, 177, 178, 180

[56] References Cited

U.S. PATENT DOCUMENTS

| | | | |
|---|---|---|---|
| 3,330,134 | 7/1967 | Carpenter | 68/178 X |
| 3,402,410 | 9/1968 | Schumm et al. | 68/178 X |
| 3,681,946 | 8/1972 | Fleissner | 68/177 X |
| 3,848,438 | 11/1974 | Tachibana et al. | 68/22 R |
| 4,103,521 | 8/1978 | Tachibana | 68/22 R |
| 5,046,209 | 9/1991 | Keilback | 68/180 X |
| 5,349,711 | 9/1994 | Iwami | 68/177 X |

FOREIGN PATENT DOCUMENTS

| | | | |
|---|---|---|---|
| 0132604A1 | 2/1985 | European Pat. Off. . | |
| 0525719A1 | 2/1993 | European Pat. Off. . | |
| 2619834 | 3/1989 | France | 68/178 |
| 2752172 | 6/1979 | Germany | 68/177 |
| 2823530 | 12/1979 | Germany | 68/177 |
| 2065 | 1/1972 | Japan | 68/27 |
| 36076 | 9/1978 | Japan | 68/178 |

*Primary Examiner*—Philip R. Coe
*Attorney, Agent, or Firm*—McGlew and Tuttle

[57] ABSTRACT

A machine is disclosed for the continuous washing of fabric (T), comprising means (3) for introducing the fabric to be treated into said machine, means (5) for extracting the treated fabric from said machine and, between said means of introduction and said means of extraction, a treatment tank. It comprises at least two fabric treatment tanks (7, 9) arranged in series with respect to the overall direction of advance of the fabric (T) through the machine and, between said at least two tanks (7, 9), means of reversible transfer (11) that transfer said fabric from the first tank (7) to the second tank (9) and back again.

22 Claims, 3 Drawing Sheets

MACHINE AND METHOD FOR THE CONTINUOUS WASHING OF A FABRIC

DESCRIPTION

1. Field of the Invention

The invention relates to a machine for the continuous washing of a fabric, of the sort that comprises means for introducing the fabric to be treated into said machine, means for extracting the fabric from said machine and, between said means of introduction and said means of extraction, a treatment tank.

2. Background of the Invention

A number of different sorts of washing machines (known technically simply as "washers") currently exist, either for washing in rope form or in open width. They can be classified basically as either continuous washers or discontinuous washers. In the former, the fabric is passed once only through the washer, where it is subjected to hydrodynamic and mechanical action designed to remove the impurities by means of a suitable washing bath. In these machines each section of the fabric is subjected to the action of the bath and of the mechanical parts, if any, for a period of time equal to the reciprocal of the product of the length of the path of the fabric through the washer and the speed of advance of the fabric. The dwell times of the fabric in the washer are therefore somewhat short and limited by, among other things, the need to keep the dimensions of the washer within acceptable values and the speed of production at competitive levels.

Qualitatively better results are obtained with so-called discontinuous washers, in which the piece of fabric to be washed is closed into a loop by joining its ends together. The fabric is then advanced along a closed path and repeatedly immersed in a tank containing the detergent before being removed from the tank and squeezed between squeezing rollers. The piece is treated for as long as is required to remove all impurities. At the end of the treatment the washer is stopped and the washed piece removed and replaced with a new piece to be washed. The results obtained with these kinds of washer are qualitatively high. Nevertheless, there are many disadvantages with discontinuous washers, including limited productivity, the need for frequent stoppages of the machine to allow for substitution of the fabric pieces, and very high consumption of detergent baths.

Furthermore, in discontinuous washers, and in some continuous washers, some parts of the fabric undergoing treatment are under tension. This is a disadvantage from the point of view of efficient washing and reduces the effects of relaxing and shrinking the fabric which are sought in washing.

SUMMARY AND OBJECTS OF THE INVENTION

The subject of the invention is a machine for the continuous washing of fabrics that will offer high productivity, low consumption of washing baths, limited pollution and results (particularly in terms of fabric shrinkage) equal or superior to those obtainable with discontinuous washers.

These and other objects and advantages, which will be clear to those skilled in the art on reading the following text, are achieved by means of a machine for the continuous washing of a fabric, characterized in that it comprises at least two fabric treatment tanks arranged in series with respect to the overall direction of advance of the fabric through the machine and, between said at least two tanks, means of reversible transfer that transfer said fabric from the first tank to the second tank and back again in order to treat each section of the fabric more than once in each of said two tanks.

The overall movement of the fabric to be treated is from the entrance to the exit of the machine at a predetermined speed of advance, but within the machine the fabric forms two accumulations which are moved alternately with and against the overall direction of advance. The two accumulations of fabric are formed in the two tanks in series and the means of reversible transfer extract part of the accumulation from one tank and transfer it to the adjacent tank and back again. In this way each section of the fabric is immersed more than once in the two tanks in series. The back-and-forth movement of the fabric is accomplished in such a way as, however, to produce an overall advance of the fabric from the entrance to the exit. The treatment is thus continuous, inasmuch as the fabric is inserted into the machine at one end and taken out after treatment from the opposite end, with no discontinuities or interruptions to the treatment. However, during its dwell time in the machine the fabric is subjected to a series of repeated operations typical of discontinuous washers, leading to better results in qualitative terms. Moreover the alternating passage from one tank to the other does not subject the fabric to localized tensions, and this makes it possible to achieve excellent processing in terms of relaxing or shrinking of the fabric.

Advantageously, the machine is constructed so as to treat the fabric in rope form rather than in open width.

For the introduction of the fabric into the machine, it is possible and advantageous to use a system comprising a tubular conveying duct through which the fabric is fed in rope form. Into the duct there may lead a tube through which a liquid is introduced into the conveying duct under pressure, its movement of flow being appropriately oriented so as to entrain the fabric. Likewise too, the means of reversible transfer, which transfer the fabric from one tank to the other and back again, may comprise, for each tank, a conveying duct optionally having a respective tube for the conveyance of a liquid. In order to simplify the structure of the machine, since the two conveying ducts interposed between the two tanks in series work alternately, a single pump means may be connected to two tubes for the liquid under pressure which alternately supply either the one or the other of said conveying ducts, a three-way valve being provided in order to direct the flow from the delivery side of the pump means as required. These pump means may advantageously be placed in communication alternately with one or the other of said tanks via another three-way valve located upstream of the pump means. The inlets of the suction ducts connected to the pump means are positioned in their respective tanks in such a way as to assist the movement of the fabric through the machine.

Other advantageous features of the invention are indicated in the accompanying claims which form an integral part of the descriptive text.

The invention also relates to a method for the continuous washing of a fabric, preferably in rope form, in which characteristically the fabric is introduced into a first tank where it forms a first accumulation of fabric, and into a second tank where it forms a second accumulation of fabric; and in which during the treatment the fabric forming said first and second accumulations is transferred alternately from said first to said second tanks and back again before being extracted from the machine.

Other advantageous embodiments of the method according to the invention are indicated in the accompanying claims.

BRIEF DESCRIPTION OF THE DRAWINGS

A clearer understanding of the invention will be provided by the description and the accompanying drawing, the latter showing a practical, non-restrictive illustrative embodiment of the invention. In the drawing.

DESCRIPTION OF THE PREFERRED EMBODIMENT

Figure 1:
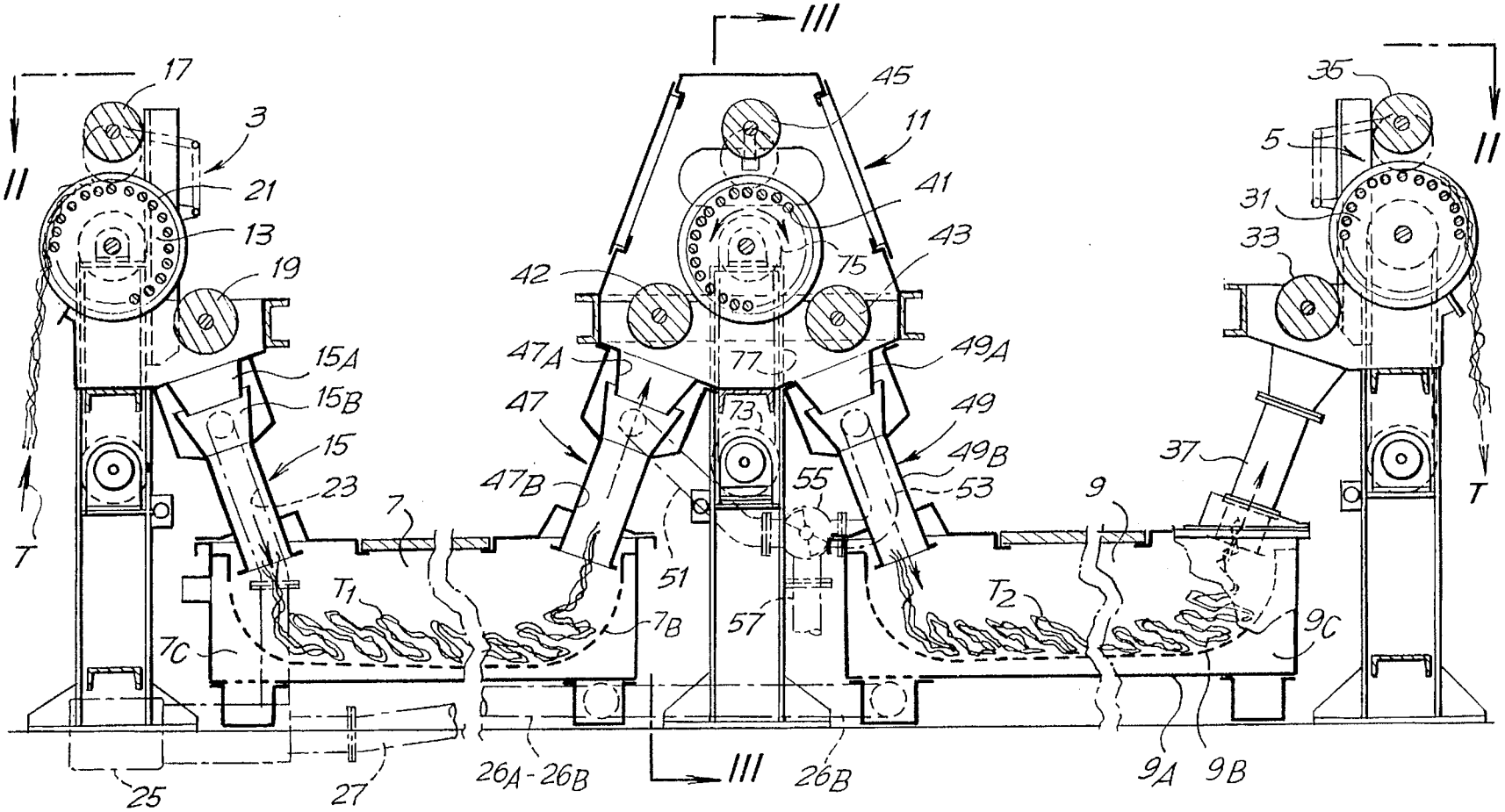
FIG. 1 shows a longitudinal section through the machine.
Figure 2:
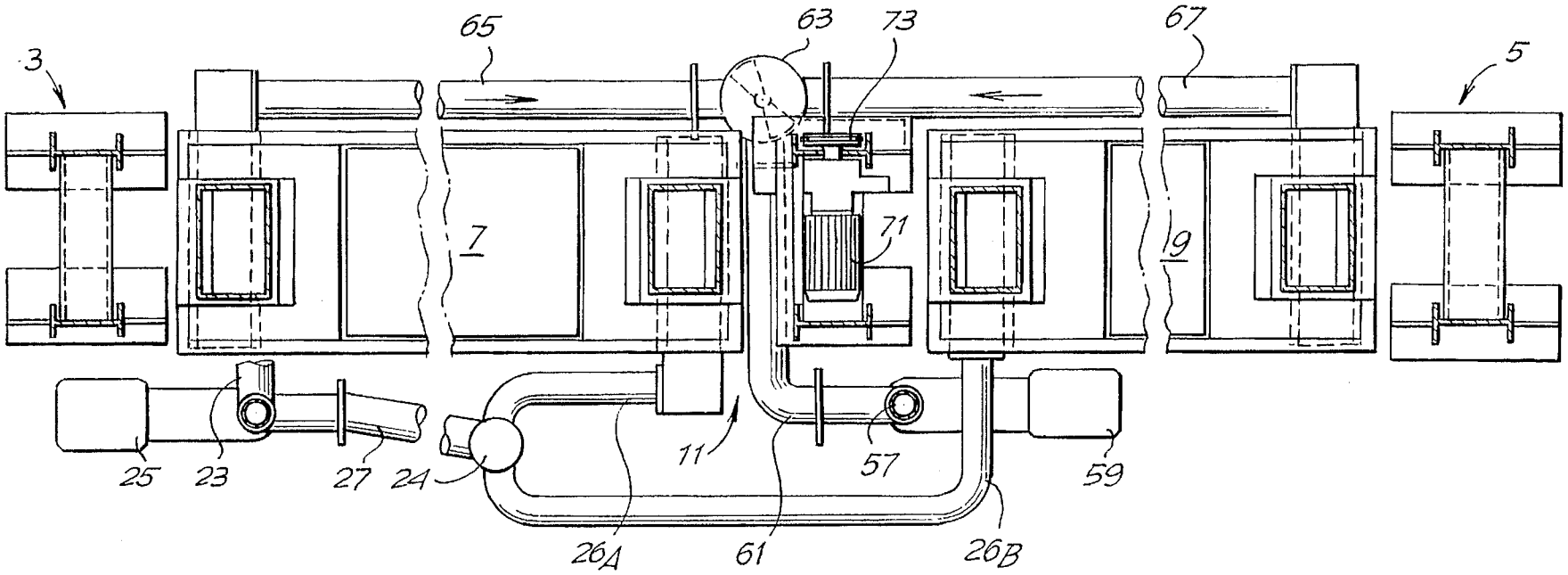
FIG. 2 shows a plan view through the plane II—II indicated in FIG. 1.

At the entrance end, the machine has fabric-introducing means indicated as a whole by the numeral 3, and at the exit end extracting means indicated as a whole by the numeral 5. Between the entrance and the exit are two tanks 7 and 9 in series, between which there are means of reversible transfer 11, capable, that is, of taking the fabric out of the tank 7 and passing it into the tank 9 and, in reverse, taking it out of the tank 9 and passing it into the tank 7.

The introducing means 3 comprise a reel 13 which rotates clockwise and passes the incoming fabric T (optionally pretreated in open width) toward a first conveying duct 15 leading into the tank 7. Arranged about the reel 13 are two cylinders 17 and 19 for applying pressure to the fabric and for guiding it. The reel 13 consists for example of a drum whose cylindrical surface, around which the fabric T travels, is formed by a plurality of bars 21 of cylindrical or approximately cylindrical section. This design of the reel allows sufficient traction to be exerted on the fabric T. The reel might also be made with a plurality of slats or with a practically continuous lateral cylindrical surface. The conveying duct comprises a first or entrance portion 15A of conical shape and a second portion 15B with a conical mouth and a cylindrical body. A tube 23 connected to the delivery side of a pump 25 leads in in the vicinity of the conical mouth of the section 15B of the duct 15. The pump 25 draws alternately from tank 7 or tank 9 via an intake tube 27, a three-way valve 24 and two intake branches 26A, 26B whose inlets are located at the end of the tank 7 furthest from the fabric entrance end and at the end of the tank 9 nearest the tank 7, respectively. In practice the intake tube 27 draws the washing liquid from tank 7 or tank 9 from below the level of the bottom 7A or 9A respectively. Above the bottom 7A, the tank 7 has a perforated wall 7B along which the fabric is carried. During operation, the level of the washing liquid is above the perforated wall 7B and covers the fabric present in the tank 7. The tank 9 likewise has a perforated wall 9B. Between the perforated walls 7B, 9B and the corresponding bottoms 7A, 9A is a space 7C and 9C respectively, full of washing liquid.

The extracting means 5 comprise an extracting reel 31 similar to the introducing reel 13, rotating clockwise and removing the treated fabric from the tank 9. Two guiding and pressing cylinders 33 and 35 act in combination with the reel 31. The treated fabric reaches the extracting reel after passing through a duct 37.

The means of reversible transfer 11 comprise a central reel 41 similar in structure to the reels 13 and 31 but with reversible drive. Two cylinders 42, 43 for guiding the fabric and an intermediate pressure cylinder 45 act in combination with the reel 41. Upstream of the central reel 41 (with respect to the direction in which the fabric passes through the machine) is a second conveying duct 47 similar in shape to the first conveying duct 15 and comprising, like the latter, a first conical portion 47A and a second portion 47B with a conical mouth and a cylindrical body. Downstream of the central reel 41 is a third conveying duct 49 similar to the conveying duct 47 and having portions 49A and 49B.

Feeding into the conical mouths of the two portions 47B and 49B of the two conveying ducts 47 and 49 are two tubes 51 and 53 connected to a single three-way valve 55. The three-way valve 55 is connected, via a tube 57, to the delivery side of a pump 59 whose intake is connected in turn to an intake tube 61. The intake tube 61 can be connected, through a three-way valve 63, alternately with a first or a second intake pipe 65 and 67. The inlet of the pipe 65 communicates with the tank 7 underneath the bottom 7A of said tank, near the inlet end, while the intake pipe 67 is connected to the tank 9, again underneath the bottom 9A of said tank 9 and at the exit end of the fabric from the tank.

Figure 3:
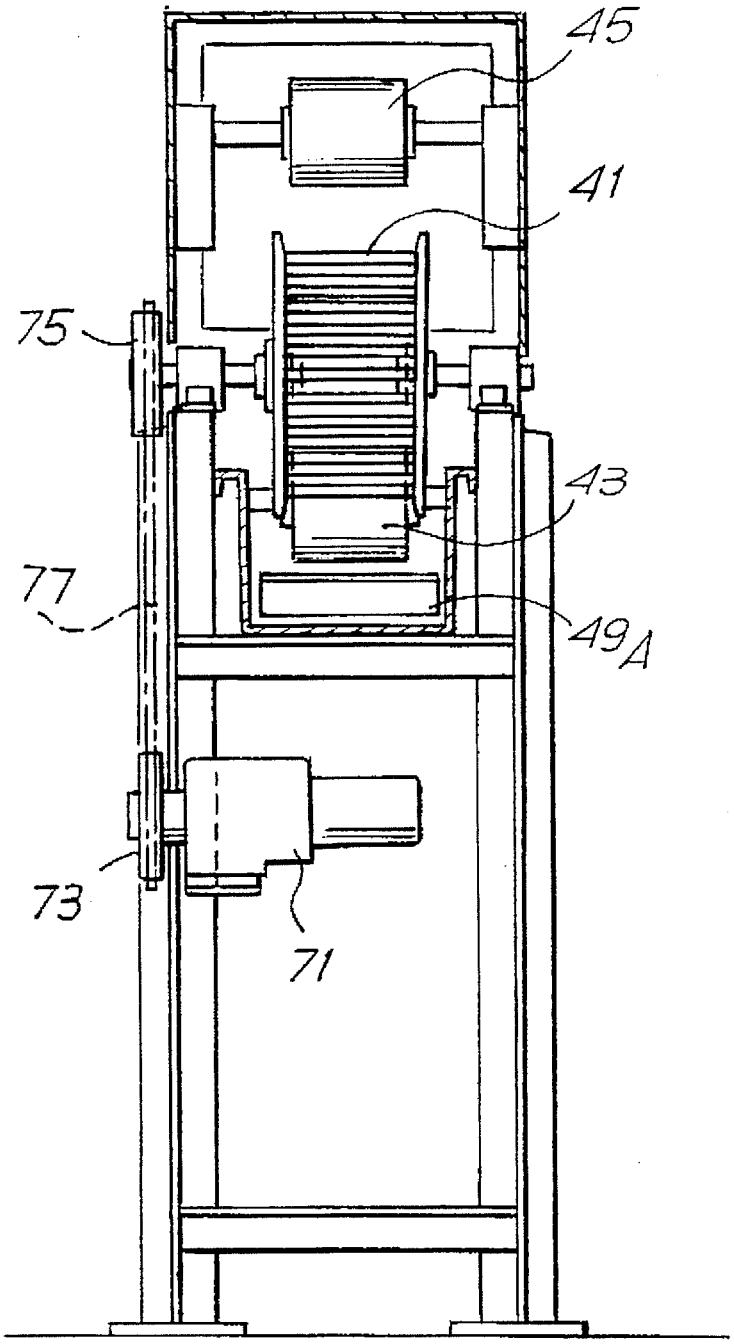
FIG. 3 shows a section through the plane III—III indicated in FIG. 1.

The numeral 71 denotes an electric motor which, via a belt 77 traveling around two pulleys 73, 75, causes the reel 41 to rotate (FIG. 3).

In one possible modified embodiment, the central reel 41 may comprise a cylindrical part made of perforated sheet metal or the like, and be internally at low pressure. The internal low pressure exerts suction on the fabric T as it travels over the reel.

Liquid that is sucked in can then be discharged or recycled, preferably into the tank 7. Suction prevents the accidental slipping of the fabric on the reel 41.

The manner in which the washing machine described above operates is as follows. During the initial loading, the fabric T is arranged around the introducing reel 13 and passed through the first conveying duct 15. It is then carried as far as the exit duct 37 and extracting reel 31 after traveling through the conveying ducts 47 and 49 and over the reel 41. The fabric is also so arranged as to form two accumulations of fabric, denoted T1 and T2 respectively, in the two tanks 7 and 9. During operation the fabric to be treated is steadily introduced by the introducing reel 13 and through the conveying duct 15 into the machine at a feeding speed equal to the speed at which the treated fabric is extracted by the reel 31 at the opposite end. The fabric present in the two tanks 7 and 9 and forming the two accumulations T1 and T2 is transferred alternately from one said tank to the other, the movement being, however, such as to produce an overall continuous movement of the fabric from the tank 7 to the tank 9.

During operation, in order to carry the fabric along, the pump 25 is constantly working and drawing washing liquid out of the tank 7 or tank 9 in order to introduce it into the first conveying duct 15, so that the fabric fed in by the reel 13 is pushed along. When the fabric is to be transferred from the tank 7 to the tank 9, the central reel 41 rotates clockwise, while the three-way valves 55 and 63 are switched so that the pump 59 draws in liquid through the intake pipe 67 from the bottom of the tank 9 and introduces it into the conveying duct 49. In this phase the pump 25 is drawing liquid through the duct 26A, and hence from the tank 7. When almost all the fabric has been accumulated in the tank 9, and there is no accumulation T2 in the tank 7, the rotary motion of the central reel 41 reverses and becomes counterclockwise. At the same time the three-way valves 55 and 63 are switched so that the pump 59 draws liquid from the tank 7 through the suction pipe 65 and introduces it into the conveying duct 47. In this phase some of the fabric which had previously been transferred out of the tank 7 to the tank 9 is returned into the tank 7, while a fraction of the fabric is removed from the tank 9 at the exit end. While the fabric T is being transferred from tank 9 to tank 7, the pump 25 is preferably drawing liquid from tank 9 through the duct 26B. This prevents the fabric T from being swamped in the opening of the conveying pipe 47.

The speed of the reels 13, 31 and 41, and the delivery rates of the pumps 25 and 59 are controlled in such a way as to provide a certain throughput of processed fabric and a suitable number of passes of each section of fabric through the two baths contained in the tanks 7 and 9.

In the example illustrated the machine has two tanks in series. The possibility of placing more than two tanks, for example three tanks in series, with means of reversible transfer between each pair of consecutive tanks, is not ruled out. Moreover the tanks may also be placed side by side, with the introducing and extracting means 3 and 5 positioned at the same end of the machine. If this solution is adopted, the means of reversible transfer 11 must also turn the fabric through 360°. Such an arrangement enables the length of the machine to be reduced. Where there are more than two treatment tanks in series, intermediate solutions can be adopted.

It will be understood that the drawing shows only an illustrative embodiment purely by way of a practical demonstration of the invention, it being possible for the invention to be altered as regards shapes and arrangements without thereby departing from the scope of the concept underlying the invention. The purpose of reference numerals, where present, in the accompanying claims, is to facilitate the reading of the claims with reference to the description and to the drawing, and does not limit the scope of protection represented by the claims. While a specific embodiment of the invention has been shown and described in detail to illustrate the application of the principles of the invention, it will be understood that the invention may be embodied otherwise without departing from such principles.

We claim:

1. A machine for the continuous washing of a fabric, comprising:

fabric introducing means for introducing the fabric to be treated into the machine;

extracting means for extracting the treated fabric from the machine;

treatment tank means disposed between said fabric introducing means and said extracting means, said treatment tank means including at least two fabric treatment tanks arranged in series with respect to an overall direction of advance of the fabric through the machine; and reversible transfer means, provided between said at least two fabric treatment tanks, for transfer of the fabric from a first tank of said at least two fabric treatment tanks to a second tank of said at least two fabric treatment tanks and back again, said reversible transfer means including a first conveying duct leading to said first tank, a second conveying duct leading to said second tank and pipes for introducing a conveying liquid under pressure, one of said pipes leading into said first conveying duct and another of said pipes leading into said second conveying duct.

2. A machine as claimed in claim 1, wherein said introducing means includes a third conveying duct through which the fabric is advanced and a tube through which a conveying liquid is introduced under pressure into said third conveying duct.

3. A machine as claimed in claim 2, further comprising pump means for drawing washing liquid from said first tank.

4. A machine as claimed in claim 3, wherein said pump means draws washing liquid from a location adjacent to an end of said first tank opposite to an end of said first tank through which the fabric to be treated is introduced.

5. A machine as claimed in claim 2, further comprising pump means connected to said tube, said pump means for drawing washing liquid alternately from said first or from said second tank.

6. A machine as claimed in claim 1, further comprising an introducing reel, upstream of said third conveying duct, said introducing reel for driving the incoming fabric and conveying the incoming fabric toward an inlet of said third conveying duct.

7. A machine as claimed in claims 6, wherein said introducing reel comprises a reel with a cylindrical surface defined by a plurality of bars of approximately cylindrical section.

8. A machine as claimed in claim 1, wherein said reversible transfer means further comprises a transfer reel that transfers the fabric from said second to said third conveying duct and back again.

9. The machine as claimed in claim 8, wherein said transfer reel is provided with slip prevention means for preventing fabric from slipping over an active surface of said transfer reel.

10. A machine as claimed in claim 9, wherein said transfer reel has a perforated active surface and means for keeping an interior of the reel at low pressure.

11. A machine as claimed in claims 8, wherein said transfer reel comprises a reel with a cylindrical surface defined by a plurality of bars of approximately cylindrical section.

12. A machine as claimed in claim 1, wherein said fabric introduction means, said extracting means, said treatment tank means and said reversible transfer means are constructed for treatment of the fabric in rope form.

13. The machine as claimed in claim 1, wherein said extraction means comprises an extraction duct and an extracting reel downstream of said extraction duct.

14. A machine as claimed in claims 13, wherein said extracting reel comprises a reel with a cylindrical surface defined by a plurality of bars of approximately cylindrical section.

15. A machine as claimed in claim 1, further comprising a common pump, said pipes being connected to a delivery side of said common pump via a three-way valve, through which the conveying liquid is supplied alternately to said first or to said second conveying duct.

16. The machine as claimed in claim 15, wherein said pump draws the liquid alternately from said first tank to supply the liquid to said first conveying duct, or from said second tank to supply liquid to said second conveying duct.

17. A machine as claimed in claim 16, wherein said pump is connected to said first and second tanks in a vicinity of ends furthest from said reversible transfer means.

18. A machine as claimed in claim 1, wherein each of said fabric treatment tanks has a perforated wall on which lies the fabric, said perforated wall forming with a bottom of the respective tank a space, the level of the liquid in each tank being greater than the height of the respective perforated wall.

19. A machine for the continuous washing of a fabric, comprising:

fabric introducing means for introducing the fabric to be treated into the machine;

extracting means for extracting the treated fabric from the machine;

treatment tank means disposed between said fabric introducing means and said extracting means, said treatment tank means including at least two fabric treatment tanks arranged on series with respect to an overall direction of advance of the fabric through the machine introducing means for introducing the fabric to be treated into the machine; and reversible transfer means, provided between said at least two fabric treatment tanks, for transfer of the fabric from a first tank of said at least two fabric treatment tanks to a second tank of said at least two fabric treatment tanks and back again, said introducing means including a conveying duct through which the fabric is advanced, and a tube, leading into said conveying duct, through which a conveying liquid is introduced under pressure into said conveying duct; and a pump means connected to said tube for drawing washing liquid alternately from said first of said fabric treatment tanks or a second of said fabric treatment tanks.

20. A method for the continuous washing of a fabric, comprising:

introducing the fabric being into a tank means containing a washing liquid;

treating the fabric in said tank means;

extracting the fabric from said tank means, wherein said tank means is provided as a first tank and a second tank;

forming an accumulation of fabric with fabric introduced into the first tank and forming a second accumulation of fabric with fabric introduced into the second tank;

transferring the fabric forming said first and second accumulations alternately from said first to said second tank and back again before being extracted from said second tank wherein the transferring of fabric forming the accumulation is transferred from said second tank to said first tank and back again by means of a liquid introduced under pressure into a respective conveying duct.

21. A method as claimed in claim 20, wherein said fabric is treated in rope form.

22. A method as claimed in claim 20, wherein the fabric is introduced into said first tank by means of entrainment by a liquid introduced under pressure into a conveying duct.

* * * * *